United States Patent [19]

Schwartz

[11] Patent Number: 4,764,651

[45] Date of Patent: Aug. 16, 1988

[54] GROUNDING OF STIRRER BUSHING IN A MICROWAVE OVEN

[75] Inventor: Anton J. Schwartz, Marion, Ohio

[73] Assignee: Whirlpool Corporation, Benton Harbor, Mich.

[21] Appl. No.: 100,015

[22] Filed: Sep. 23, 1987

[51] Int. Cl.[4] ..... H05B 6/74

[52] U.S. Cl. ..... 219/10.55 F; 219/10.55 D

[58] Field of Search ..... 219/10.55 F, 10.55 R, 219/10.55 E, 10.55 D, 10.55 M; 174/35 R

[56] References Cited

U.S. PATENT DOCUMENTS

| | | | |
|---|---|---|---|
| 3,127,494 | 3/1964 | Kellough et al. | 219/10.55 F |
| 3,526,737 | 9/1970 | Black | 219/10.55 F |
| 4,296,297 | 10/1981 | Miller | 219/10.55 F |
| 4,429,204 | 1/1984 | McGuire et al. | 219/10.55 F |
| 4,458,126 | 7/1984 | Dills et al. | 219/10.55 F |
| 4,618,756 | 10/1986 | Schwaderer et al. | 219/10.55 R |
| 4,641,006 | 2/1987 | Ross et al. | 219/10.55 F |

*Primary Examiner*—Philip H. Leung

*Attorney, Agent, or Firm*—Mason, Kolehmainen, Rathburn & Wyss

[57] ABSTRACT

In a microwave oven, a stirrer bushing is used to rotatably mount a shaft of a stirrer paddle through a wall for a portion of a waveguide duct so that the stirrer paddle may be rotatated within the waveguide duct. The stirrer bushing has an externally threaded stem portion adapted to be threadedly inserted into a stirrer nut clinched in the top wall of the portion of the waveguide duct located above a cooking cavity of the microwave oven. During the staking of the stirrer nut in the top wall, raised ridges or serrations are formed which project from the top wall into the waveguide duct. A head portion of the stirrer bushing has its underside surface provided with serrations projecting toward the stem portion of the stirrer bushing. As the stirrer bushing is installed into the stirrer nut, the serrations on the head of the stirrer bushing abrade against the raised ridges formed in the top wall. As a result, the paint covering the top wall is scraped away and the stirrer bushing becomes effectively shorted to the grounded wall of the waveguide duct to prevent leakage of electromagnetic energy from the waveguide duct.

17 Claims, 2 Drawing Sheets

56
72
18
70
76
74
20
64
42
12
44
40
46
48
50
52
54
66
68
78
80
82
5
6

GROUNDING OF STIRRER BUSHING IN A MICROWAVE OVEN

BACKGROUND OF THE INVENTION

A. Field Of The Invention

The present invention generally relates to the grounding of a bushing for a stirrer shaft of a stirrer paddle in a microwave oven and, more particularly, to a new and improved method and apparatus for the grounding of the stirrer bushing by having serrations on the head of the stirrer bushing abrade against raised ridges on a wall of a cavity in the microwave oven.

B. Description Of The Prior Art

Microwave ovens are used in the home and in commercial establishments to heat food items placed within a cooking cavity of the microwave oven. In certain microwave ovens, a stirrer blade or paddle is disposed in a cavity located above the cooking cavity forming a portion of a waveguide duct extending from a magnetron producing the microwave energy to the cooking cavity. The stirrer paddle is used effectively to stir the microwave energy that is being transmitted through the waveguide duct to the cooking cavity in order to enhance the distribution of the microwave energy delivered to the cooking cavity. As a result, the food items in the cooking cavity are more uniformly heated.

One such type of microwave oven having a stirrer is disclosed in U.S. Pat. No. 4,618,756; and another is disclosed in U.S. Pat. No. 4,429,204. In both of these patents, the stirrer paddle is disclosed as being mounted in the microwave energy feedbox or waveguide duct located above the cooking cavity. A stirrer shaft for rotating the stirrer paddle extends through the top wall of the waveguide duct from a mechanism used to rotate the stirrer shaft and thereby the stirrer paddle.

In order to permit the stirrer shaft to rotate, the stirrer shaft may extend through the top wall in a stirrer bushing. The stirrer bushing has an externally threaded stem portion which may be threadedly engaged into a threaded passage of a stirrer nut affixed to the top wall by applying an appropriate torque to a head portion of the stirrer bushing disposed at one end of the stem portion. The stirrer bushing must be grounded to the top wall of the waveguide duct so as to prevent RF leakage from occurring from the waveguide duct to the outside of the microwave oven. Even though the underside surface of the head of such a stirrer bushing engages the top wall of the waveguide duct when the stirrer bushing is threaded into the stirrer nut, some prior art stirrer bushings had a tendency to be insufficiently grounded to the top wall of the waveguide duct because the top wall normally is painted.

In the above-mentioned U.S. Pat. '204 patent, a nut is disclosed as securing a bushing in a top wall of a cavity located above a cooking cavity of a microwave oven. The nut may be provided with a serrated face to improve the electrical conductivity to the cavity if the wall is painted (column 3, lines 32–35). However, such a serrated nut does not ensure that the stirrer bushing is consistently grounded to such a painted wall.

U.S. Pat. Nos. 1,783,446; 1,875,930; 3,213,914; 3,750,525; 4,543,023 and 4,557,651 disclose fasteners having some type of irregular surface, groove or recess on the head or shank of the fastener to secure the fastener to a panel or the like. However, none of these prior art patents disclose or suggest any way to enhance the grounding of a fastener to a surface or wall when that surface is painted as is the case with the painted internal wall surfaces in a microwave oven.

SUMMARY OF THE INVENTION

An object of the present invention is to provide new and improved method and apparatus for grounding a stirrer bushing in a microwave oven.

Another object of the present invention is to provide a new and improved method and apparatus for grounding a stirrer bushing by having serrations about the underside surface of a head portion of the stirrer bushing abrade against matching raised ridges formed on a wall of a cavity in the microwave oven to which the stirrer bushing is secured.

Another object of the present invention is to provide a new and improved method and apparatus for grounding a stirrer bushing to a painted wall of a cavity in a microwave oven by having serrations on a head portion of the stirrer bushing abrade against raised ridges on the wall so that the paint covering the wall is scraped or removed to ground the stirrer bushing.

In accordance with the above objects of the present invention, a method and apparatus are disclosed herein for shorting or grounding a stirrer bushing, that rotatably mounts a shaft of a stirrer paddle, to a grounded wall of a waveguide duct in a microwave oven. The stirrer bushing has an externally threaded stem portion adapted to be inserted threadedly into a stirrer nut clinched in the top wall of the portion of the waveguide duct located above a cooking cavity of the microwave oven. During the staking of the stirrer nut in the top wall, raised ridges or serrations are formed which project from the top wall into the waveguide duct. A head portion of the stirrer bushing has its underside surface provided with serrations projecting toward the stem portion of the stirrer bushing. As the stirrer bushing is installed into the stirrer nut, the serrations on the head of the stirrer bushing abrade against the raised ridges formed in the top wall. As a result, the paint covering the top wall is scraped away and the stirrer bushing becomes sufficiently grounded to the wall of the waveguide duct to prevent leakage of electromagnetic energy from the waveguide duct.

BRIEF DESCRIPTION OF THE DRAWING

Many other objects, advantages and novel features of the present invention will become apparent from the following detailed description of a preferred embodiment of the present invention considered in conjunction with the drawing in which.

DESCRIPTION OF THE PREFERRED EMBODIMENT

Figure 1:
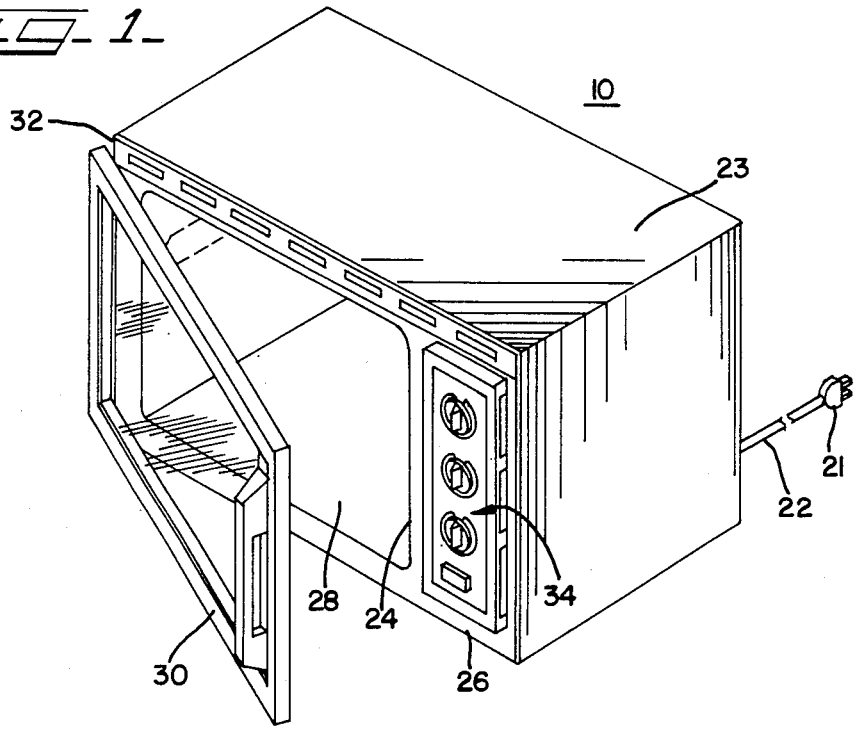
FIG. 1 is a perspective view of a microwave oven constructed in accordance with the principles of the present invention.
Figure 2:
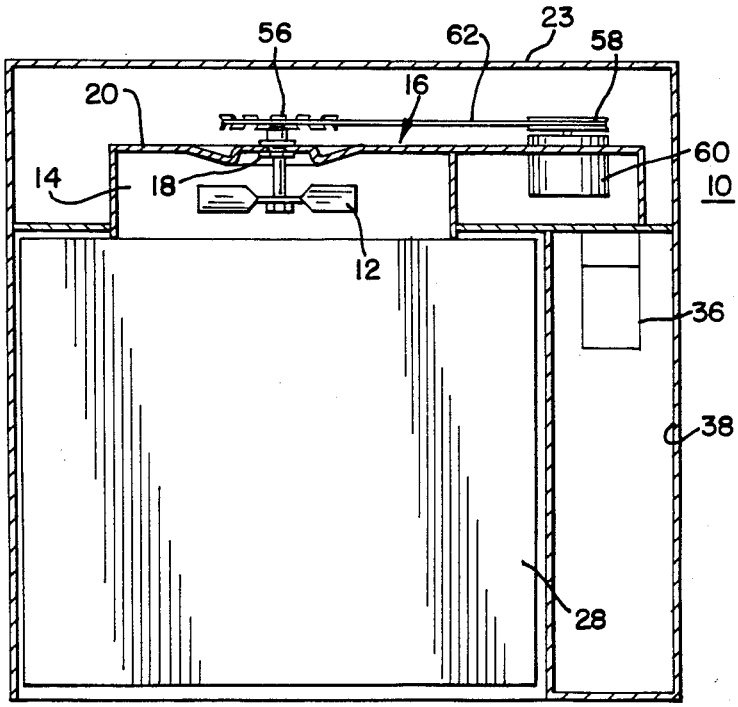
FIG. 2 is a diagrammatic cross sectional view of the microwave oven of FIG. 1 including a representation of a stirrer paddle disposed in a waveguide duct of the microwave oven.

Referring now more specifically to FIGS. 1 and 2 of the drawing, therein is disclosed a microwave oven 10 having a stirrer paddle or blade 12 rotatably mounted within a cavity 14, forming a portion of a waveguide duct 16, by a stirrer bushing 18. In accordance with an important feature of the present invention, the stirrer bushing 18 is electrically shorted or grounded to a top wall 20 of the cavity 14. The top wall 20 in turn is electrically connected to an earth ground through a conventional three-prong plug 21 of a conventional power cord 22 for supplying power to the microwave oven 10. In the past, stirrer bushings used in the microwave oven 10 tended to be inadequately grounded to the wall 20 because, conventionally, the walls of the microwave oven 10 are painted. The stirrer bushing 18 is effectively electrically shorted or grounded to the painted top wall 20 to prevent the leakage of electromagnetic energy from the cavity 14.

An outer housing 23 forms an outer shell for the microwave oven 10. An opening 24 in a front panel 26 provides access through the front panel 26 into a cooking cavity 28. The front opening 24 may be sealed by a front door 30 mounted along an edge 32 of the front panel 26. A set of controls 34 is disposed on the front panel 26 adjacent to the opening 24. The controls 34 are adapted to regulate the heating cycles of and other functions performed by the microwave oven 10.

A magnetron (not specifically shown) is disposed in an enclosure 36 (FIG. 2) in a side chamber 38 located adjacent to the cooking cavity 28 and behind the cooking controls 34. The magnetron generates the electromagnetic energy in the microwave frequency range that is used to cook or heat food items or the like placed in the cooking cavity 28. The waveguide duct 16 directs the microwave energy generated by the magnetron to the cooking cavity 28. The stirrer paddle 12 is provided within the waveguide duct 16 effectively to stir the microwave energy that is being transmitted to the cooking cavity 28 to effect the uniform distribution of the microwave energy in the cooking cavity 28.

The stirrer paddle 12 (FIGS. 3–4) is secured to a threaded end portion 40 of a stirrer shaft 42 by a nut 44. The stirrer shaft 42 includes the threaded end portion 40, a spacer portion 46 of the stirrer shaft 42 for maintaining a separation between the stirrer bushing 18 and the stirrer paddle 12 and a drive shaft 48. The drive shaft 48 extends through and is rotatably journaled in an axial passage 50 in a stem portion 52 of the stirrer bushing 18 such that the passage 50 provides a bearing surface in which the drive shaft 48 may be rotated. A distal end 54 of the drive shaft 48 is affixed to a pulley 56. When an output pulley 58 (FIG. 2) is driven by a motor 60, a belt 62 rotates the pulley 56 so that the stirrer paddle 12 also is rotated. Since none of the microwave energy being transmitted through the waveguide duct 16 can be allowed to leak from the waveguide duct 16 to the outside of the microwave oven 10, the stirrer bushing 18 must be consistently and effectively grounded to the top wall 20 of the cavity 14.

Figures 3, 4, 5, 6:
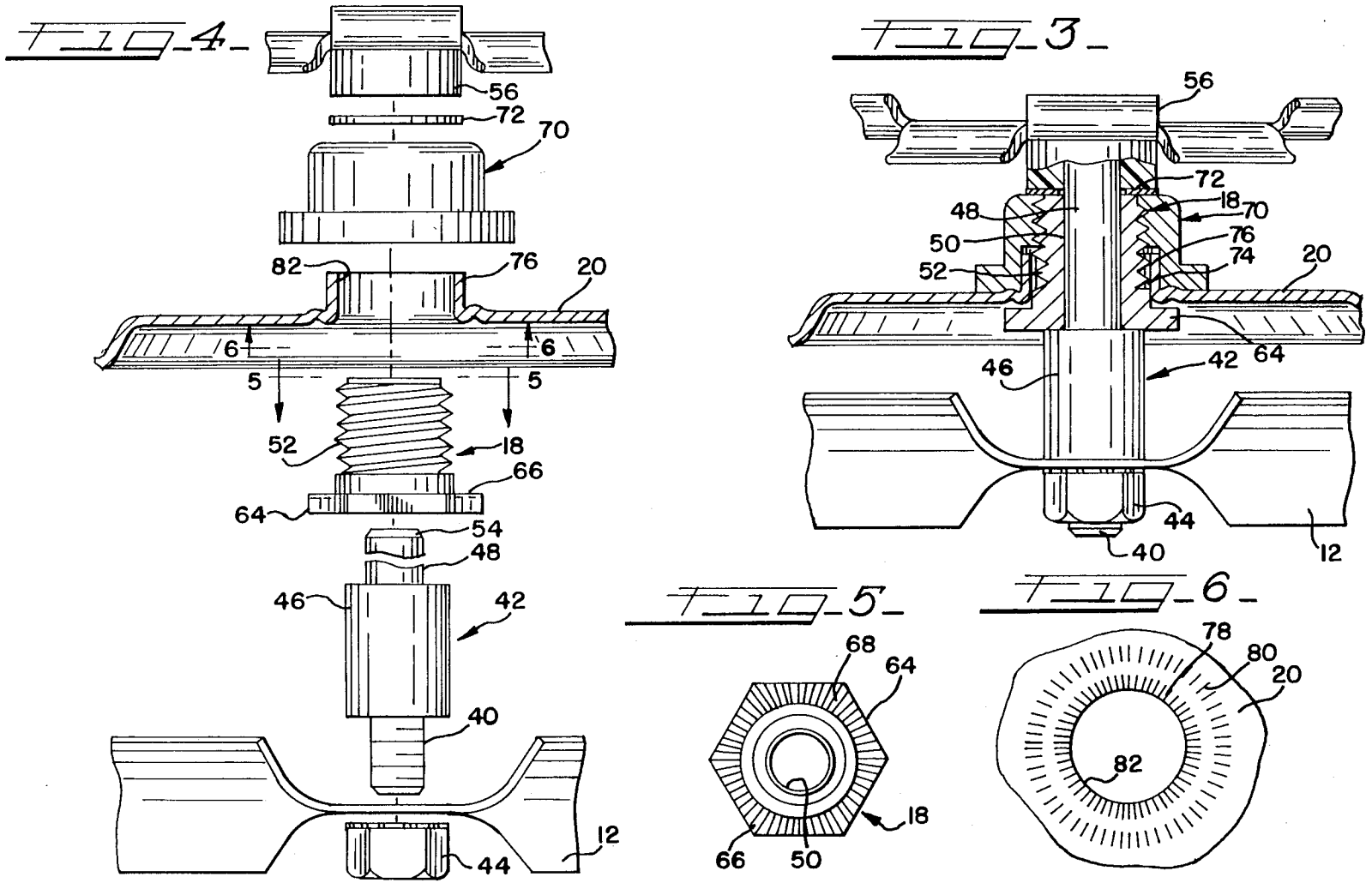
FIG. 3 is an enlarged, fragmentary, partially cross sectional view of a portion of the microwave oven of FIG. 1 showing the mounting of a shaft of a stirrer paddle in a stirrer bushing affixed by a stirrer nut to a top wall of the waveguide duct disclosed in FIG. 2.
FIG. 4 is an exploded, elevational view of the components depicted in FIG. 3.
FIG. 5 is a cross sectional view taken along line 5—5 in FIG. 4.
FIG. 6 is a cross sectional view taken along line 6—6 in FIG. 4.

The stirrer bushing 18 is made of a conductive metal material, such as porous bronze. As seen in FIGS. 3–5, the stem portion 52 of the stirrer bushing 18 is externally threaded and the stirrer bushing 18 has a head portion 64 at one end of the stem portion 52. While disclosed as hexagonal in shape, the head portion 64 may be of any other appropriate shape. An underside or flange surface 66 of the head portion 64 has serrations 68 (see FIG. 5) formed thereon. For example, fifty serrations 68 are provided, the serrations 68 being equally spaced about the underside surface 66 of the head portion 64, and the teeth or raised ridges formed by the serrations 68 extend from the underside surface 66 of the head portion 64 a distance of approximately 0.127 millimeter (mm) to approximately 0.380 mm. Preferably, the angle formed between the side edges of each tooth of the serrations 68 and the underside surface 66 is approximately 45 degrees.

As seen in FIG. 3, the externally threaded stem portion 52 of the stirrer bushing 18 is adapted to be threadedly inserted into a stirrer nut 70. A washer 72 is positioned between the stirrer nut 70 and the pulley 56 so that the pulley 56 is free to rotate relative to the stirrer nut 70. The stirrer nut 70 has an enlarged passage 74 at one end. In order to secure the stirrer nut 70 to the top wall 20 of the cavity 14, the stirrer nut 70 is staked or clinched to the top wall 20 by a suitable staking tool or punch (not shown). As the stirrer nut 70 is so clinched to the top wall 20, a portion 76 of the top wall 20 is deformed into the passage 74 (FIG. 3) and raised ridges 78 and 80 are formed in the top wall 20 about an opening 82 formed by the deformed portion 76 of the top wall 20 (FIG. 6). The ridges 78 extend or project from the top wall 20 into the cavity 14 and are adapted to engage the serrations 68 formed on the underside 66 of the head portion 64 of the stirrer bushing 18.

When the stem portion 52 of the stirrer bushing 18 is inserted through the top wall 20 and threadedly secured in the stirrer nut 70, the serrations 68 abrade or scrape against the ridges 78 formed on the cavity top wall 20. Consequently, paint covering the ridges 78 is removed and the stirrer bushing 18 is effectively shorted to the wall 20 and, thereby, is grounded. For example, a torque of 60–75 inch-pounds may be applied to the head portion 64 of the stirrer bushing 18 to ensure that the stirrer bushing 18 is properly installed in the stirrer nut 70 and to ensure that the paint covering the top wall 20 is sufficiently scraped or abraded so that the stirrer bushing 18 is properly shorted to the top wall 20 and is, thereby, grounded.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. A microwave oven comprising:

a waveguide duct extending between a source of microwave energy and a cooking cavity, a mechanical stirrer within said waveguide duct for distributing said microwave energy, driving means disposed externally of said waveguide duct and connected to a drive shaft of said stirrer for rotating said stirrer, a stirrer bushing formed of electrically conductive material and having a stem portion in which said stirrer drive shaft is rotatably journaled and a head portion, said head portion having serrations, retaining means for securing said stirrer bushing to a wall of said waveguide duct and ridges on said wall projecting into said waveguide duct and disposed in abrading physical contact with said serrations.

2. A microwave oven as set forth in claim 1 wherein said retaining means is a stirrer nut clinched to said wall, said ridges being formed on said wall when said stirrer nut is clinched to said wall.

3. A microwave oven as set forth in claim 1 wherein said wall is painted, portions of said paint having been scraped from said ridges upon the abrading contact between said serrations and said ridges.

4. A microwave oven as set forth in claim 1 wherein said retaining means is a stirrer nut having a threaded passage, wherein said stem portion of said stirrer bushing has external threads and wherein said abrading contact between said ridges and said serrations is effected upon the installation of said threaded stem portion into said threaded passage.

5. A microwave oven as set forth in claim 1 wherein fifty serrations are provided on the head portion of said stirrer bushing.

6. A microwave oven as set forth in claim 1 wherein each of said serrations forms a tooth extending out from said head portion toward said stem portion of said stirrer bushing.

7. A microwave oven as set forth in claim 6 wherein said tooth extends a distance of approximately 0.127 millimeter to approximately 0.380 millimeter from said head portion at an angle of approximately 45 degrees from the surface of said head portion.

8. Apparatus electrically shorting a stirrer bushing used as a bearing rotatably mounting a stirrer drive shaft of a stirrer extending into a cavity of a microwave oven to a wall of said cavity, said stirrer bushing having a head portion and an externally threaded stem portion threadedly engageable in a stirrer nut affixed to said cavity wall externally of said cavity, comprising serrations on a surface of said head portion of said stirrer bushing and raised ridges on said cavity wall projecting into said cavity, said serrations abrading against said ridges as said stem portion is installed in said stirrer nut.

9. Apparatus electrically shorting a stirrer bushing as set forth in claim 8 wherein said stirrer bushing is made of a conductive material.

10. Apparatus electrically shorting a stirrer bushing as set forth in claim 9 wherein said stirrer bushing is made of a porous bronze material.

11. Apparatus electrically shorting a stirrer bushing as set forth in claim 8 wherein said cavity wall is painted and said serrations remove at least a portion of said paint as said serrations abrade against said ridges.

12. Apparatus electrically shorting a stirrer bushing as set forth in claim 8 wherein said serrations project from a flange surface of said head portion toward said stem portion.

13. Apparatus electrically shorting a stirrer bushing as set forth in claim 8 wherein said stirrer nut is clinched to said cavity wall and said ridges are formed in said cavity wall as said stirrer nut is clinched to said cavity wall.

14. A method of electrically connecting a stirrer bushing used as a bearing for rotatably mounting a stirrer drive shaft of a stirrer to a wall of a cavity in a microwave oven, said stirrer bushing having a stem portion and a head portion with serrations on said head portion, said method including the steps of:

securing a stirrer nut to said wall, forming raised ridges on said cavity wall, said ridges projecting into said cavity, and installing said stem portion of said stirrer bushing into said stirrer nut, said serrations on said head portion of said stirrer bushing abrading against said ridges as said stem portion is installed in said stirrer nut so that said stirrer bushing becomes electrically shorted to said cavity wall.

15. A method of grounding a stirrer bushing as set forth in claim 14 wherein said cavity wall is painted and the abrading of said serrations against said ridges removes at least a portion of the paint from said ridges.

16. A method of grounding a stirrer bushing as set forth in claim 14 wherein said ridges are formed as said stirrer nut is secured to said cavity wall.

17. A method of grounding a stirrer bushing as set forth in claim 14 wherein said stirrer nut is secured to said cavity wall by clinching a portion of said cavity wall into a passage in said stirrer nut and wherein said ridges are formed as said stirrer nut is clinched to said cavity wall.

* * * * *